US005704504A

United States Patent [19]

Bueno

[11] Patent Number: 5,704,504

[45] Date of Patent: Jan. 6, 1998

[54] PLASTIC BOTTLE FOR HOT FILLING

[75] Inventor: Carlos Eduardo de Siqueira Bueno, São Paulo, Brazil

[73] Assignee: Rhodia-Ster Fipack S.A., Camaçari, Brazil

[21] Appl. No.: 432,191

[22] PCT Filed: Sep. 1, 1994

[86] PCT No.: PCT/BR94/00033

§ 371 Date: Aug. 14, 1995

§ 102(e) Date: Aug. 14, 1995

[87] PCT Pub. No.: WO95/06593

PCT Pub. Date: Mar. 9, 1995

[30] Foreign Application Priority Data

Sep. 2, 1993 [BR] Brazil ..... 9303188

[51] Int. Cl.[6] ..... B65D 1/40

[52] U.S. Cl. ..... 215/381; 215/382; 220/673; D9/556

[58] Field of Search ..... 215/381, 382, 215/383; 220/669, 670, 673, 675; D9/552, 556, 565, 569

[56] References Cited

U.S. PATENT DOCUMENTS

| | | | |
|---|---|---|---|
| 1,602,391 | 10/1926 | Creaver | 215/384 |
| 2,139,143 | 12/1938 | Wiswell | 220/907 X |
| 2,335,260 | 11/1943 | Chamberlain | 220/670 X |
| 3,029,963 | 4/1962 | Evers | 215/382 X |
| 3,956,441 | 5/1976 | Uhlig . | |
| 4,538,439 | 9/1985 | Frei | 220/673 X |
| 4,572,412 | 2/1986 | Brach et al. | 215/382 X |
| 5,054,632 | 10/1991 | Alberghini . | |
| 5,101,990 | 4/1992 | Krishnakumar et al. | 215/383 |
| 5,178,289 | 1/1993 | Krishnakumar et al. | 215/382 |
| 5,199,588 | 4/1993 | Hayashi | 215/381 |
| 5,209,372 | 5/1993 | Norwood | 215/383 X |
| 5,224,623 | 7/1993 | La Fleur | 220/669 |

FOREIGN PATENT DOCUMENTS

| | | | |
|---|---|---|---|
| 0320151 | 6/1989 | European Pat. Off. . | |
| 405097143 | 4/1993 | Japan | 220/666 |
| 317512 | 8/1929 | United Kingdom . | |
| 856958 | 1/1959 | United Kingdom . | |

*Primary Examiner*—Stephen P. Garbe
*Assistant Examiner*—Christopher J. McDonald
*Attorney, Agent, or Firm*—Darby & Darby

[57] ABSTRACT

A plastic bottle for filling with hot liquid, of the type including a circumferential lateral wall (10), which is incorporated at its lower part to a bottom portion (F) and at its upper part to a neck portion (G) of said bottle. A plurality of grooves (20) are incorporated along the lateral wall (10) and disposed slightly inclined in relation to the longitudinal axis of the bottle and spaced between the bottom portion (F) and the neck portion (G). The grooves (20) are substantially parallel and spaced from each other by panels (11) of the lateral wall (10) and the grooves (20) have a wall thickness which is symmetrical in relation to the respective longitudinal planes of symmetry and which is dimensioned so that the grooves provide a vertical reinforcement, absorb homogeneously and make imperceptible the circumferential thermal and mechanical contractions of the bottle after cooling.

15 Claims, 3 Drawing Sheets

PLASTIC BOTTLE FOR HOT FILLING

FIELD OF THE INVENTION

The present invention refers, in general terms, to a bottle for hot filling, and more particularly to a one-way plastic bottle, which is going to be filled with a hot liquid.

BACKGROUND OF THE INVENTION

Liquid foodstuffs, such as natural fruit juices, milk, vegetal oils and the like, medicinal solutions and suspensions, as well as other liquid products for human ingestion, in order to be adequately conditioned should be sterilized before or during bottling, usually being subjected to thermal treatments, such as pausterization.

In these processes, the liquid is either hot sterilized and bottled in equally sterilized containers, or bottled and sterilized together with the open container. The capping is subsequently effected onto the still hot assembly.

Until the liquid cools down to the room temperature, it suffers a reduction in its volume. Since the container is hermetically sealed, the vacuum generated by the contraction of the liquid mass tends to draw the wall of said container, causing the collapse thereof.

To the bottler, it is fundamental to keep the good image of his product, i.e., to present both the container and label in perfect conditions, till said product is purchased by the costumer. It is therefore inadmissible to have a distorted bottle with a label that has wrinkled and torn due to the deformation of the wall.

Traditionally, the bottles used in the conditioning of liquids for human ingestion are made of glass, which is the material presenting the higher number of mechanical and visual characteristics, such as transparency, required for that purpose. Nevertheless, because the glass is breakable and heavy, it has become of high cost, due to the high number of bottle breaks during handling. Moreover, the transportation of glass greatly increases the cost of the product.

With the evolution of the petrochemical industry and the consequent rise of new thermoplastic materials, much effort has been made in trying to obtain a material, which would be adequate to the manufacture of bottles to be hot filled and which would impart to said bottles the typical glass characteristics of transparency, indeformability and perfect label fixation, associated with low weight and high impact resistance.

The tests with first generation thermoplastics, such as polyethylenes, polypropylenes and polyvinyl chloride (PVC), produced bottles with little resistance to collapse, insufficiently transparent, or presenting both said inconveniences.

The second generation thermoplastics, such as nylon, produced vessels with good mechanical resistance, but with a milky aspect, almost opaque and expensive.

The technique of the third generation thermoplastics, known as the generation of the engineering plastics, i.e., the plastics adequate to be used in engineering pieces, such as gears, structural elements, etc., has produced a material of high transparency and excelent mechanical characteristics, which was potentially useful to the manufacture of one-way containers for liquids: the polyethylene terephthalate, usually known by the sigla PET. Due to the above cited qualities, the PET has been widely and increasingly used in the manufacture of bottles to be filled with cold liquid. Nevertheless, when filled with hot liquids, the PET bottles have presented problems related to the collapse of their walls after cooling.

The above cited problem has been faced by the industry in several manners. Firstly, as a more immediate solution, attempts were made to increase the weight of the container. The tests, in which the wall thickness was increased, have proved to be effective for solving the problem of mechanical deformation cited above, i.e., the collapse of the bottle due to the contraction of the liquid when cooling. Nevertheless, there has been observed a second factor of deformation in said bottles, which is the thermal deformation caused by the contraction of the constructive material of said bottles during the cooling process of the bottled product.

Since the distribution of the material along the wall of any blown bottle is heterogenous, and considering that the larger the amount of the material, the more said material will contract, due to the existence of regions of higher wall thickness and therefore more subjected to contraction, the lateral wall of the bottle will suffer differentiated longitudinal contractions, causing distortion in the container, which will be visually jeopardized.

Moreover, due to the relatively high cost of this thermoplastic polymer, even slight increases in the weight of the material of the bottle will result in an excessive increase in its cost, making it less competitive in relation to the glass bottle, thereby resulting in the definitive infeasibility of such solution to the problem.

It has been observed that the PET bottles, manufactured to be filled with cold liquids and having different wall designs produced for aesthetical purposes only, presented different behaviors when they contracted due to cooling, after being filled with a hot liquid. This verification made the blowing industry concentrate on modifying the walls of the bottles, increasing their collapse resistance for a given thickness.

In general terms, the works which were carried out indicated the following post-cooling behaviors of the hot filled bottles, in function of the modifications made in the walls:

The provision of rings, i.e., circumferential grooves or ribs, spacedly applied along the wall, resulted in good resistance to the diametral or circumferential contraction, thereby avoiding the collapse of the bottle; nevertheless, because there was no resistance to the vertical contraction, the longitudinal deformations due to a more accentuated thermal contraction of the material of the bottle in the thickest region of the latter resulted in deformation, displacing the neck of the bottle from its longitudinal axis, in other words, distorting said bottle.

The provision of vertical grooves or ribs, angularly spaced around the wall, resulted in good resistance to vertical contraction, thereby avoiding the distortion of the bottle; but the bottles with this type of shape collapsed due to the mechanical circumferential deformation caused by vacuum; and The provision of faceted walls, i.e., those walls presenting flat faces, joined by respective vertical edges, presented improved mechanical properties, but, due to the already cited heterogeneous thickness of the wall in blown containers, the unequal contraction of said bottle caused the collapse thereof.

Such results have made the technicians try an obvious solution, which is the combination of both circumferential and vertical grooves or ribs, compensating the deficiencies of said solutions when separately applied. Though integrally solving the problems of bottle contraction, such construction presented a new problem, which practically made impossible its application. Due to the fact that said bottle had only small quadrangled convex areas, which did not allow the adequate application of the label of the product, said label was invariably damaged during the handling of the bottle, which usually occurred long before its exposure in the market, when the costumer had difficulty to identify the product.

Finally, the industry has found a feasible solution, which is presently wordly used in large scale in the production of bottles for hot filling. The bottle comprises portions of lateral walls in the form of panels or "bubbles", projecting outwardly from the regular contour of the bottle, said panels absorbing a considerable part of the contraction of the liquid and passing from a convex shape to a concave shape. The remainder of the wall has a very strong structure, overdimensioned in order to allow the bottle to withstand the remainder of the liquid contraction that was not absorbed by the panels, besides guaranteeing that said bottle will not suffer thermal deformation regarding the longitudinal axis thereof: Nevertheless, also in this case the label has a deficient anchorage, due to the concavity of the panels, thus being deformed and partially destroyed during the handling of the bottle.

For this reason, the bottle for hot filling constructed with contractible panels is becoming more and more unacceptable by the bottler who is conscious of the image of his product.

DISCLOSURE OF THE INVENTION

Thus, it is a general object of the present invention to provide a bottle for hot filling , which presents a high mechanical resistance, yet requires little constructive material.

It is a particular object of the present invention to provide a bottle as described above, which will be submitted to a controlled mechanical deformation and reduced thermal deformation when contracted due to cooling, so as not to present easily noticeable critical deformations, independently from the distribution of the thickness of the wall of the bottle.

It is another particular object of the present invention to provide a bottle as cited above, in which there is no deformation or destruction of the label during the handling of said bottle.

It is a further object of the invention to provide a bottle as described above, which has low weight, in order to efficiently contribute to the reduction of the transportation cost of the product contained therein.

These and other objectives and advantages of the present invention are attained through the provision of a bottle for hot filling, of the type including a circumferential lateral wall, which is incorporated at its lower part to a bottom portion and at its upper part to a neck portion of said bottle, and comprising a plurality of grooves, incorporated along the lateral wall and disposed sligtly inclined in relation to the longitudinal axis of the bottle and spacedly in relation to the bottom and neck portions of the latter, said grooves being substantially parallel and spaced from each other by panels of said wall and having a wall thickness, which is symmetrical in relation to the respective longitudinal planes of symmetry and which is dimensioned so that said grooves provide a vertical reinforcement, absorb homogeneously and make imperceptible the circumferential thermal and mechanical contractions of the bottle after cooling.

The bottle for hot filling of the present invention, though requiring minimum thermoplastic material for its construction and therefore being extremely light and of low cost, has an overdimensioned structural disposition, which allows the bottle to suffer thermal deformation due to the contraction caused by the cooling of the plastic, as well as mechanical deformation (due to vacuum generated by the contraction caused by the cooling of the liquid), said deformations being controlled and presenting a final aspect without visually perceptible deformations and a substantially cylindrical shape which permits a perfect anchorage of the label onto the wall of the bottle.

In function of the above mentioned qualities, associated with its transparency, the proposed bottle is an extremely unexpensive and efficient means for the bottler to promote his product, thus contributing to reinforce the good image of his company in the market.

BRIEF DESCRIPTION OF THE DRAWINGS

The invention will be described below, with reference to the attached drawings, in which.

BEST MODE OF CARRYING OUT THE INVENTION

According to the above described figures, the bottle for hot filling, blown in a thermoplastic polymer, such as terephtalate polyethylene (PET), includes a wall 10, which is slightly convex and incorporated at its lower part to a bottom portion F and at its upper part to a neck portion G of said bottle, and which is provided with a plurality of mechanical structural reinforcements in the form of grooves 20, which may be inclined or helical and which are separated by respective panels 11 of said wall 10, said panels extending along the latter, the ends of said grooves being spacedly disposed in relation to the bottom portion F and neck portion G of the bottle, said grooves acting during the cooling of the hot capped bottle, as described ahead. The action of the grooves 20 is based on the following facts, known in the art of plastic molding: a) said grooves are points for accumulating the stresses in molded pieces, concentrating all the work generated from the physical modifications suffered by said pieces; b) said grooves always present points of higher concentration of material; and c) higher concentration of material is subjected to higher dimensional variations, under the effect of thermal variation. Thus, based on a), it is understood that all the work resulting from the mechanical contraction of the bottle, due to the vacuum produced by the contraction of the liquid, will occur in the regions of the grooves 20; and b) and c) show that said grooves 20 will accordingly be the points of convergence of the work of thermal contraction, resulting from the contraction due to the cooling of the constructive material of the bottle. The manner by which the mechanical and thermal contrations occur will be described below.

Figure 3:
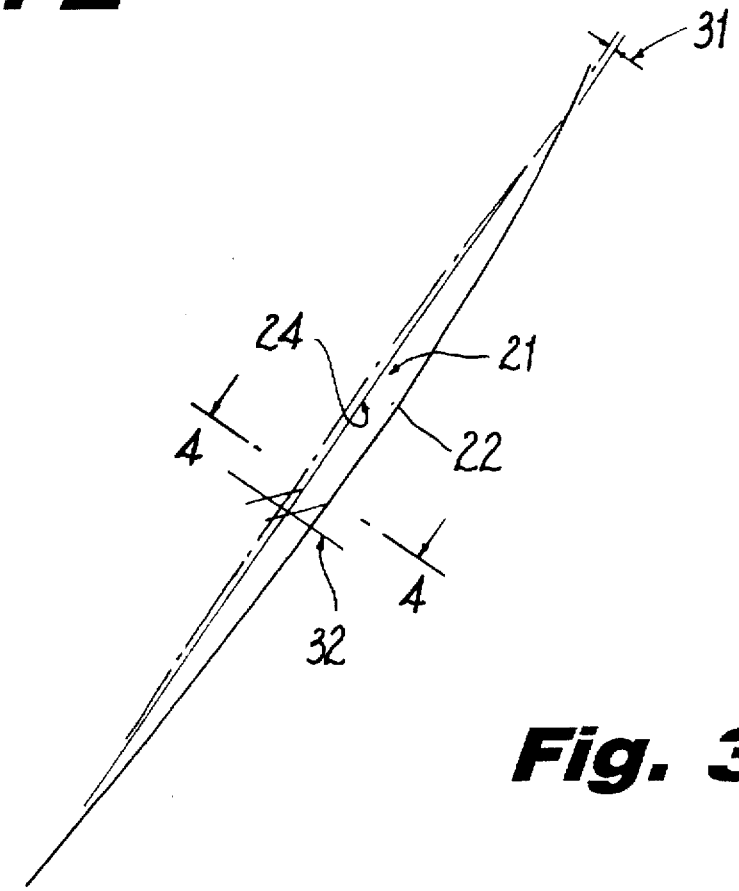
FIG. 3 illustrates in full lines a schematic section view of one of the grooves applied to the wall of the bottle, taken according to the line 3—3 of FIG. 1, and showing in dash and dot lines the same groove in the thermally deformed condition of the bottle.
Figure 4:
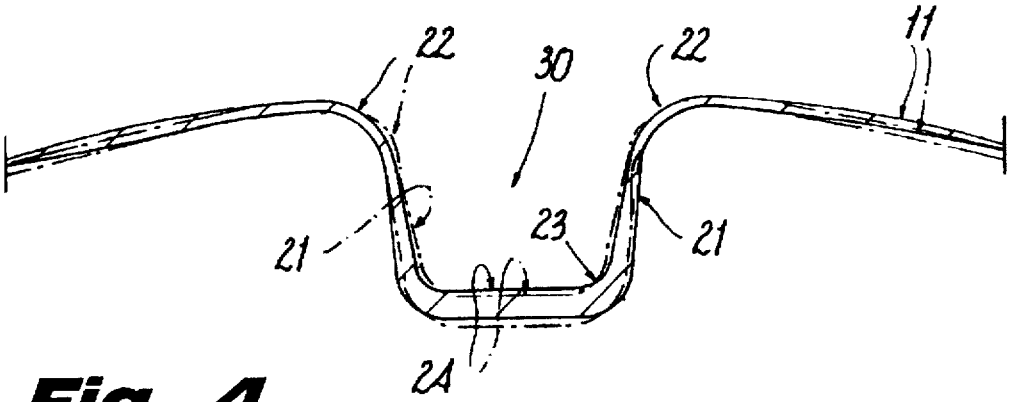
FIG. 4 is an enlarged section view of one of the grooves applied to the wall of the proposed bottle, taken according to the line 4—4 of FIG. 3.

As illustrated in FIG. 3, each groove 20 has a substantially trapezoidal cross section, opened at its larger base, the sides thereof being equal and defining groove lateral walls 21, which are incorporated by one of the ends thereof to the adjacent panels 11 through respective external curves 22, the free ends of said lateral walls 21 incorporating respective internal curves 23, which are joined by the smaller base of the trapeze, defining a bottom wall 24 of said groove 20.

As for the distribution of the polymer in each groove 20, at a given nominal thickness of the wall 10 of the bottle, the external curves 22 define the points of maximum stretching of the material of the bottle, i.e., the points where the least amount of material is accumulated. Along its lateral walls 21, the groove accumulates increasing quantities of material, till the point of maximum accumulation is reached at the region of the bottom wall 24 thereof, accumulating an amount of material that is substantially thicker than the wall portions 11. In order that the thermal and mechanical contractions of the bottle may be homogeneously absorbed by each groove 20, it is essential that the construction of said bottle be totally symmetrical, as described above.

Every blown material has the tendency to return to its primitive contracted form, constituting the so called plastic memory. The larger the material accumulation and the slower the cooling of the blown piece, the more sensible will be said plastic memory.

In the hot bottling processes, the bottles, after being filled up and capped, are submitted to forced cooling, through jets of cold water, and to drying through cold air again and then labeled. With the aim of obtaining more productivity and economy of space in the bottling line, the bottles are thus submitted to conditions of sudden contraction.

Thus, according to its design, the bottle of the present invention has a plastic memory which is extremely more sensible at the bottom wall 24 of the grooves 20, a more sensible plastic memory at the lateral walls 21, from the internal curves 23 of said grooves 20 and at the panels 11 of the wall 10, but a less sensible memory at the regions of the external curves 22 of the grooves 20.

In the conditions of sudden cooling described above, a great part of the thermal contraction will occur at the bottom walls 24 of the grooves 20, making said walls more concave, the remainder of said contraction being distributed along the lateral walls 21 of said grooves 20 and along the panels 11 of the wall 10, making them become slightly concave, whereby the total deformation of the bottle by thermal contraction will be imperceptible.

Figure 1:
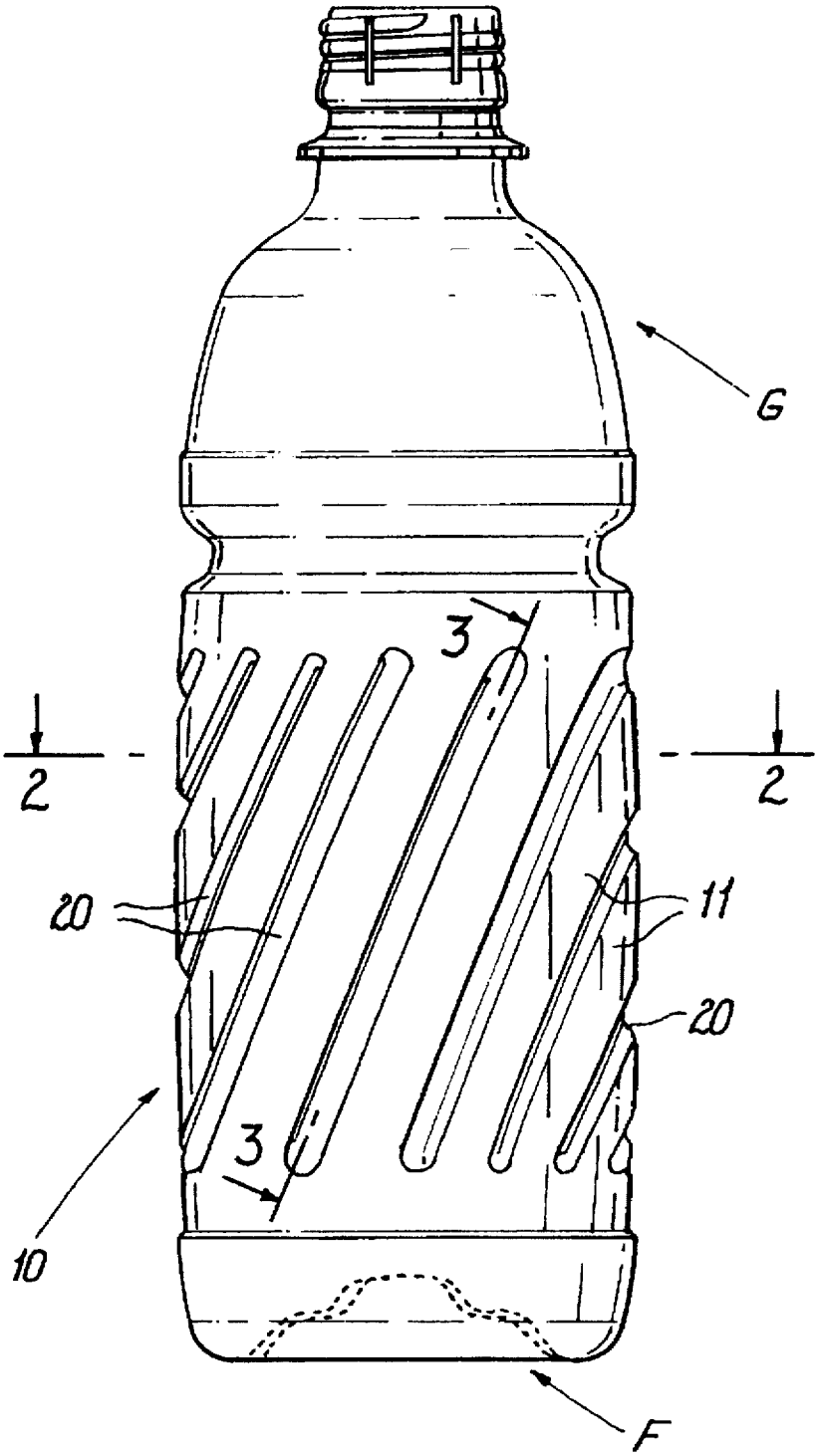
FIG. 1 is a lateral view of the bottle for hot filling of the present invention.
Figure 2:
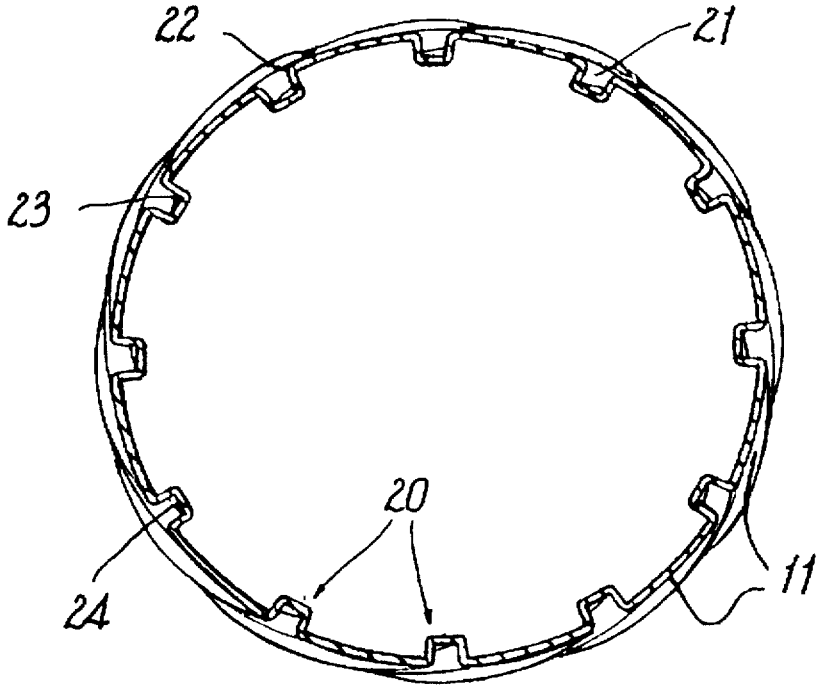
FIG. 2 is a diametral section view, taken according to the line 2—2 of FIG. 1.

Due to the inclination of the grooves 20, the parameter of reinforcement thereof may be decomposed in a circumferential component and in a vertical component, which respectively act against the collapse of the bottle, due to the mechanical contraction and to a slight thermal contraction of said bottle, and against the deviation of the longitudinal axis of the bottle caused by the thermal contraction. According to FIG. 1, the grooves 20 are less inclined in relation to the longitudinal axis of the bottle than in relation to the perpendicular plane of said longitudinal axis, thus providing more vertical reinforcement to said bottle, consequently avoiding the collapse thereof, as well as permitting a controlled circumferential contraction, as described below.

After the cooling and the consequent thermal contraction of the bottle, the liquid contained therein also cools and contracts, generating the vacuum that will cause its mechanical deformation.

As it will be observed below, in the cold bottle condition, the wall distribution, as cited above, has a reinforcement effect opposite to that in the hot bottle condition, subjected to thermal contraction.

During the mechanical contraction of the bottle, there occurs the drawing of the panels 11 of the wall 10, said drawing tending to move said panels radially towards the longitudinal axis of the bottle. This effort of the panels 11 is absorbed at the thinnest wall regions of the bottle, i.e., at the external curves 22 that get closer to each other, reducing the openings of the grooves 20 at the lateral walls 21 thereof, said grooves slightly deforming at the position adjacent to said walls, forming in said regions small sinuosities and slight deformation in the panels 11 of the wall 10, in a way that is totally imperceptible with the naked eye.

As it can be observed, such solution permits that a great part of the dimensional reduction of the bottle occurs inside said bottle, thus being totally imperceptible with the naked eye. Since the external dimensional reduction is minimum, as defined above, it will also be imperceptible. Thus, it may be concluded that the proposed solution solves, in a new and complete way, the problem of critical deformations due to the cooling of the hot filled plastic bottles.

As already described, the second most important problem to be solved in the bottles for hot filling refers to the provision of a good surface for attaching the label of the product. The good condition of the label at the market point will allow the easy identification of the product by the customer, besides transmitting a good image of both the product and manufacturer.

A plastic bottle as described above concentrates both the mechanical and thermal contractions at the grooves 20 of the wall 10, the latter being evidently submitted to a certain diametral reduction, in such a way that an initially cylindrical bottle would present a slight wall concavity when ready to be consumed, resulting in an acceptable surface, but inadequate for the application of a label.

The ideal surface for the perfect adaptation of a label on a bottle is substantially cylindrical. In order to obtain such cylindricity, it is essential that the panels 11 of the wall 10 present a thickness/width relation, so as to avoid a perceptible mechanical deformation, when the grooves 20 undergo a mechanical deformation caused by the cooling of the bottle. Moreover, the width of each groove 20 should be dimensioned so as to provide a maximum contact surface of the label with the wall 10 of the bottle, in order to guarantee the maintenance of the desired visual aspect of said label. The maximum possible approximation between adjacent panels 11 should therefore be provided in the cooled condition of the capped bottle.

Figure 5:
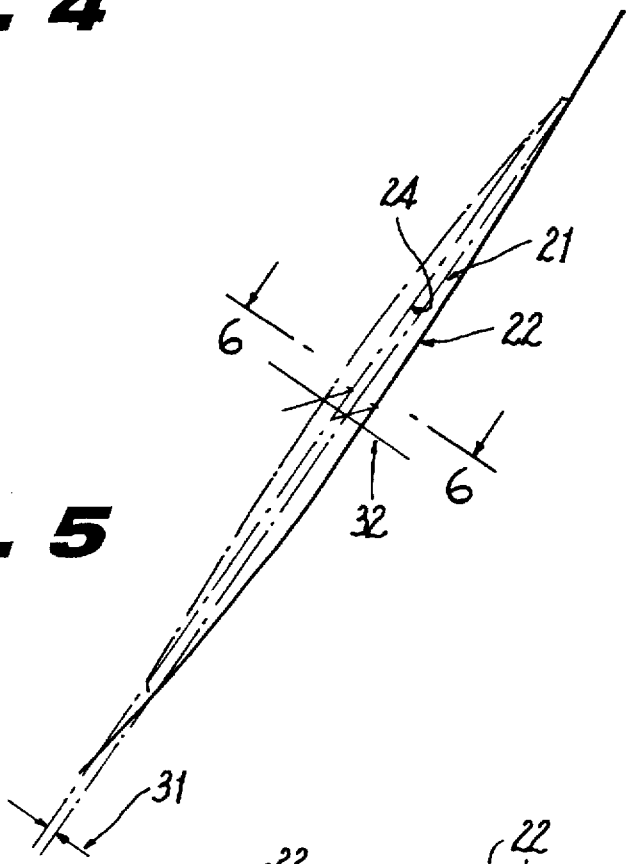
FIG. 5 is a similar view to that of FIG. 3, but showing in dash and dot lines the groove in the mechanically deformed condition of the bottle.
Figure 6:
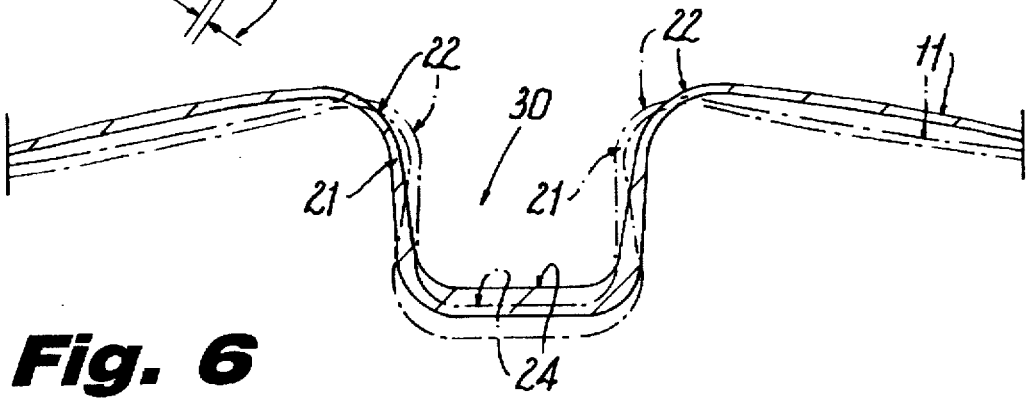
FIG. 6 is a similar view to that of FIG. 4, taken according to line 4—4 of FIG. 5.

The grooves 20 present an increasing depth, from the ends towards the central portion thereof. According to the mechanisms of concentration and the distribution of stresses and of material, as defined above and illustrated in FIG. 5, when the bottle is submitted to mechanical contraction, the wall thereof becoming cylindrical, the deformation of each groove 20 causes the accentuated concavity of the bottom wall 24.

Surprisingly, there has also been observed that the vertical deformation of the proposed bottle is accompanied by a certain torsion. It is thus configurated a bellows effect, assuring a substantial homogeneous vertical deformation along the longitudinal axis of said bottle.

The present invention has been described as applied to a PET bottle, for this polymer has privileged mechanical and optical characteristics, as already mentioned. Nevertheless, considering the weight parameter of the bottle, in function of less physical requirements, it should be observed that the bottle in question may be constructed in PE, PP, PVC, among others materials, and still present improved thermo-mechanical characteristics in relation to the bottles using the same material, but produced according to the known techniques.

The dimensions of the inventive elements may vary, in function of the general dimensions and capacity of the bottle, of the desired mechanical requirements, as well as the molecular orientation determined to the constructive material in each case.

There will be listed below, as an illustrative embodiment of the present invention, the relevant dimensions of a PET bottle of 500 ml, designed to be filled with concentrated fruit juices:

wall thickness: 0,25–0,40 mm wall height: 95,74 mm arrow of the wall convexity: 1 mm inclination of the ribs: 55° minimum depth of the ribs: 1,5 mm maximum depth of the ribs: 2,5 mm spacing between the ribs: 17,1 mm larger diameter of the free wall: 67,3 mm larger diameter of the contracted wall: 65,3 mm

I claim:

1. A plastic bottle for filling with a hot liquid, said bottle comprising:

a bottom section;

a substantially cylindrical lateral wall section above said bottom section; and a neck above said substantially cylindrical lateral wall section;

said substantially cylindrical lateral wall section having a single set only of a plurality of helical grooves spaced equally therearound parallel to each other, each groove having a pair of side walls extending from said lateral section and a connecting bottom wall and each pair of adjacent grooves defining a curved panel part of said lateral wall section therebetween, the panel parts defined by said plurality of grooves each having substantially the same area, said grooves to provide a vertical reinforcement for the said lateral wall and to absorb circumferential thermal and mechanical contractions of the bottle.

2. A plastic bottle according to claim 1, wherein said lateral wall is slightly convex in the direction of the height of said bottle before being filled, said grooves having increased depth from the ends to the central portion thereof, said depth being dimensioned to permit deformation of said grooves after the full capped bottle has cooled tending to bring said panel parts together, said lateral wall assuming a configuration with a substantially rectilinear generatrix.

3. A plastic bottle according to claim 1, wherein each groove has a substantially trapezoidal cross section which is opened at its larger base at the surface of said lateral wall, the side walls of a groove being equal with one end thereof joined to the adjacent panel part through an external curve connection, the other ends of said side walls incorporating respective internal curves which are joined by the smaller base of the trapezoid, defining a bottom wall of a said groove.

4. A plastic bottle according to claim 1, wherein the panels of said lateral wall have a thickness/width relation adequate to maintain the perceptible mechanical indeformability of said panels when said grooves mechanically deform due to the cooling of the capped bottle.

5. A plastic bottle according to claim 1, wherein the width of each groove is dimensioned to permit application of a label that is glued onto said lateral wall section.

6. A plastic bottle as in claim 1, wherein the cross-section of the bottle is symmetrical in a plane transverse of the bottle longitudinal axis in the area of the lateral wall section.

7. A bottle as in claim 1, wherein each said groove is linear along its length.

8. A plastic bottle according to claim 1, wherein said grooves are at angle of greater than 45° relative to the horizontal.

9. A plastic bottle according to claim 3 wherein said groove varies from a bottom wall of thicker material, and said side walls tapering down in thickness from said bottom wall to said panel part of said lateral wall.

10. A plastic bottle for filling with a hot liquid, said bottle comprising:

a bottom section;

a substantially cylindrical lateral wall section above said bottom section; and a neck above said substantially cylindrical lateral wall section;

said substantially cylindrical lateral wall section having a plurality of helical grooves spaced therearound parallel to each other, each pair of adjacent grooves defining a curved panel part of said lateral wall section therebetween, said grooves to provide a vertical reinforcement for the said lateral wall and to absorb circumferential thermal and mechanical contractions of the bottle, wherein the external curves of the groove have a minimum thickness of material, defining a region of minimum thermal contraction and maximum mechanical contraction of the bottle, the panel parts of said bottle lateral wall and said groove lateral walls of said groove having a medium thickness of material defining regions of medium thermal and mechanical contractions, said groove bottom wall having maximum thickness of material defining a region of maximum thermal contraction and minimum mechanical contraction of said bottle.

11. A plastic bottle for filling with a hot liquid, said bottle comprising:

a bottom section;

a substantially cylindrical lateral wall section above said bottom section; and a neck above said substantially cylindrical lateral wall section;

said substantially cylindrical lateral wall section having a plurality of helical grooves spaced therearound parallel to each other, each pair of adjacent grooves defining a curved panel part of said lateral wall section therebetween, said grooves to provide a vertical reinforcement for the said lateral wall and to absorb circumferential thermal and mechanical contractions of the bottle, wherein each said groove has opposing side walls extending inwardly of said lateral wall section and a bottom wall joining the ends of said side walls, said bottom wall being thicker than the thickness of said panels of said lateral wall section.

12. A bottle as in claim 11 wherein said bottom wall of said groove is thicker than the said side walls of said groove.

13. A plastic bottle for filling with a hot liquid, said bottle comprising:

a bottom section;

a substantially cylindrical lateral wall section above said bottom section; and a neck above said substantially cylindrical lateral wall section;

said substantially cylindrical lateral wall section having a single set only of a plurality of helical grooves spaced therearound parallel to each other, each pair of adjacent grooves defining a curved panel part of said lateral wall section therebetween, said grooves to provide a vertical reinforcement for the said lateral wall and to absorb circumferential thermal and mechanical contractions of the bottle, wherein each groove has a substantially trapezoidal cross section which is opened at its larger base at the surface of said lateral wall, the side walls of a groove being equal with one end thereof joined to the adjacent panel part through an external curve connection, the other ends of said side walls incorporating respective internal curves which are joined by the smaller base of the trapezoid, defining a bottom wall of a said groove.

14. A plastic bottle according to claim 13, wherein said lateral wall is slightly convex in the direction of the height of said bottle before being filled, the walls of said grooves having increased depth from the ends to the central portion thereof, said depth being dimensioned to permit deformation of said grooves after the full capped bottle has cooled tending to bring said panel parts together, said lateral wall assuming a configuration with a substantially rectilinear generatrix.

15. A plastic bottle according to claim 13 wherein said groove varies from a bottom wall of thicker material, and said side walls tapering down in thickness from said bottom wall to said panel part of said lateral wall.

* * * * *